United States Patent [19]

Harbian

[11] 4,301,891

[45] Nov. 24, 1981

[54] CLIMBING APPARATUS

[76] Inventor: Jivan Harbian, 400 Kent Dr., Wentzville, Mo. 63385

[21] Appl. No.: 153,024

[22] Filed: May 27, 1980

Related U.S. Application Data

[63] Continuation-in-part of Ser. No. 66,517, Aug. 15, 1979, abandoned.

[51] Int. Cl.[3] ..... E06C 1/00; A63B 27/02

[52] U.S. Cl. ..... 182/135; 182/136; 182/189

[58] Field of Search ..... 182/133, 134, 135, 136, 182/100, 189, 221; 287/10, 12

[56] References Cited

U.S. PATENT DOCUMENTS

| | | | |
|---|---|---|---|
| 810,254 | 1/1906 | Borneman | 182/134 |
| 1,307,468 | 6/1919 | Wells | 182/135 |
| 2,311,352 | 2/1943 | Seiler | 182/135 |
| 3,033,309 | 5/1962 | Fugere | 182/189 |

FOREIGN PATENT DOCUMENTS

| | | | |
|---|---|---|---|
| 4619 | 2/1892 | Switzerland | 182/135 |

*Primary Examiner*—Reinaldo P. Machado
*Attorney, Agent, or Firm*—F. Travers Burgess

[57] ABSTRACT

Climbing apparatus includes a pole which may be positioned vertically or inclined, an element axially slidably, but non-rotatably, mounted on the pole for supporting the feet of a climber and a second element non-rotatably but axially slidably mounted on the pole for supporting the hands of a climber. Both the hand and foot supporting elements include selectively actuable brake shoes engageable with the pole. The non-rotatable mountings of both elements on the pole permit the pole to be positioned either vertically or inclined from the vertical as desired. A second embodiment of the invention provides a seat element similarly non-rotatably but axially slidably mounted on the pole above the foot supporting element and connected thereto by resilient tension means for causing the foot supporting element to follow the seat element upwardly during ascent, the seat element being provided with a brake shoe disengaged from the pole when the seat is unoccupied and engageable with the pole responsive to occupation of the seat.

6 Claims, 11 Drawing Figures

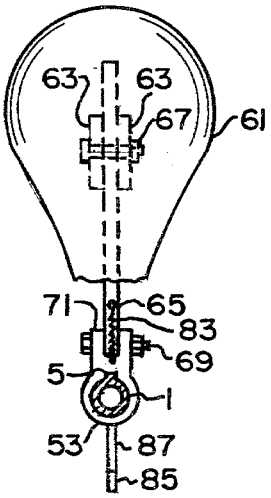
FIG. 16.
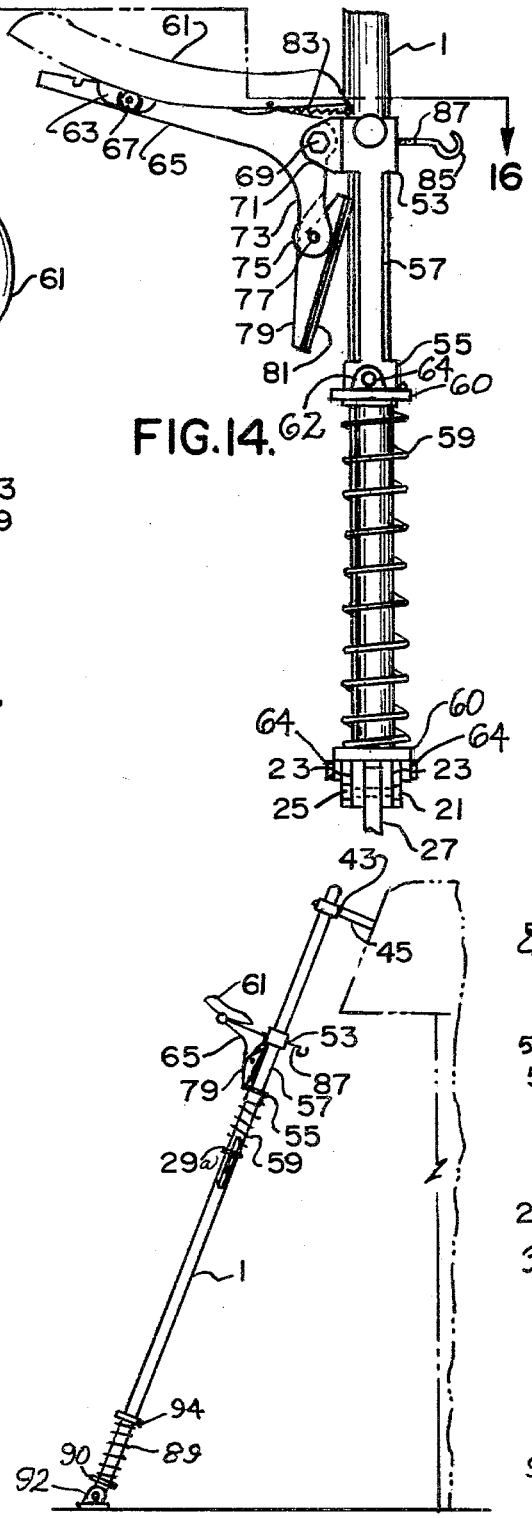
FIG. 14.
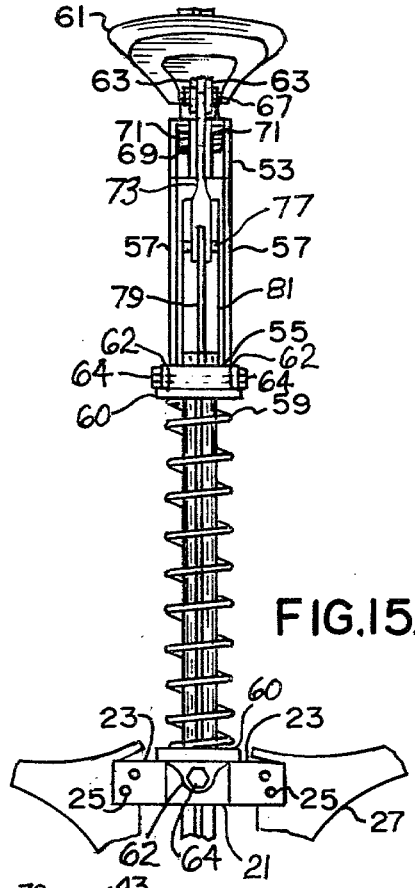
FIG. 15.
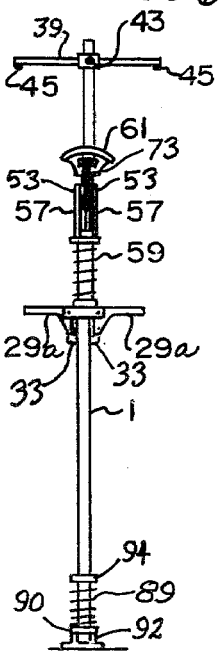
FIG. 12.
FIG. 13.

CLIMBING APPARATUS

This application is a continuation-in-part of my copending application Ser. No. 66,517, filed Aug. 15, 1979 and now abandoned.

BACKGROUND OF THE INVENTION

1. Field of the Invention

The invention relates to climbing apparatus of the type having separate hand or seat and foot supporting elements slidably mounted in axially spaced relation on a pole or similar member.

2. The Prior Art

The prior art discloses a number of devices exemplified in Von Mengden U.S. Pat. Nos. 213,715, Borneman 810,254, Westad 983,335, O'Keefe 3,724,593 and Fonte 4,137,995 constructed for climbing vertical or substantially vertical generally cylindrical objects, such as telephone or telegraph poles, ropes and the like. One feature generic to all of these disclosures in the prior art is that the element climbed, whether it be a telegraph pole, as in the patent to Von Mengden, a special pole, as in the patent to Borneman, ropes, as in the Westad and O'Keefe patents, or a telephone pole, as in the Fonte patent, must be substantially vertical. In the interest of stability, however, a pole used in the manner of a ladder is preferably inclined.

SUMMARY OF THE INVENTION

The present invention relates to climbing apparatus having movable hand engaged elements on a seat and foot supporting element slidably but non-rotatably mounted on a pole for movement axially thereof, capable of use in the manner of a conventional ladder.

More particularly, the foot supporting and hand engaged elements and seat have collars non-rotatably mounted on the pole and respectively have a pair of hand engaged or foot supporting arms mounting brake shoes so that when vertical loads are applied to the arms, the brake shoes engage the pole and prevent movement of the respective elements axially of the pole.

The invention utilizes hand engaged and foot supporting elements comprising collars non-rotatably but axially slidably mounted on the pole, a pair of bellcranks pivotally secured to each collar on diametrally opposite sides of the collar and each having a transverse arm and an arm parallel to the pole, and brake shoes secured to arms of the bellcranks parallel to the axis of the pole and brakingly engageable with the pole when pressure is applied to the substantially horizontal foot supporting or hand engaged arms of the bellcranks.

Non-rotatable mounting of the collars on the pole permits the pole to be used in an inclined as well as a substantially vertical position by preventing a climber from swinging around to the underside of an inclined pole.

The non-rotatable mounting is achieved by utilizing a non-circular cross section pole and collars of mating cross section.

BRIEF DESCRIPTION OF THE DRAWINGS

FIG. 12 is a side elevation of a modified form of the climbing apparatus having a seat in place of the hand supporting element of FIGS. 1–11.

FIG. 13 is a front elevation of the modified climbing apparatus illustrated in FIG. 12.

FIG. 14 is an enlarged fragmentary side elevational view of the apparatus illustrated in FIGS. 12 and 13.

FIG. 15 is an enlarged fragmentary front elevational view of the apparatus illustrated in FIG. 14.

FIG. 16 is a horizontal sectional view taken along line 16—16 of FIG. 14.

DETAILED DESCRIPTION OF THE INVENTION

Figure 3:
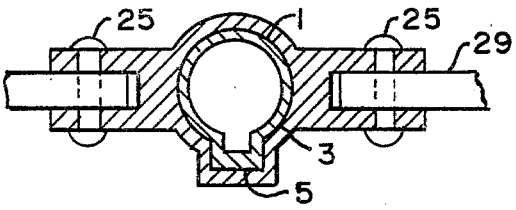
FIGS. 3, 4 and 5 illustrate various cross sections of the pole and mating collars.

The numeral 1 denotes a pole which may be of extruded aluminum construction and of non-circular cross section having a generally circular body 3 and a radial rib 5 elongated parallel to the axis of the pole.

A hand supporting element comprises a collar 7 having an internal surface mateable with the pole and a pair of radial wings 9 on a common diameter substantially at right angles to the diameter intersecting the radial rib 5 of the pole. A pair of hand supporting members in the form of bellcranks having slightly upwardly curved transverse arms 11 with thickened ends 12 and much shorter arms 13 extending downwardly generally parallel to the axis of pole 1 are fulcrummed at the intersections of arms 11 and 13 on wings 9 by pins 15. The upward curvature of hand supporting arms 11 and the thickened outer end portions 12 oppose any tendencies of the hands to slip off hand supporting arms 11. For maintaining the hand supporting element at any desired position on pole 1, brake shoes 17, having concave surfaces engageable with opposite sides of pole 1, are pivoted at 19 to the lower portions of axial arms 13 of the bellcranks so that when downward pressure is applied to transverse arms 11, the hand supporting element will be held against vertical movement on pole 1 and by lifting up on transverse arms 11 brake shoes 17 can be disengaged from engagement with pole 1, permitting free upward or downward movement of the hand supporting element on the pole.

Figure 10:
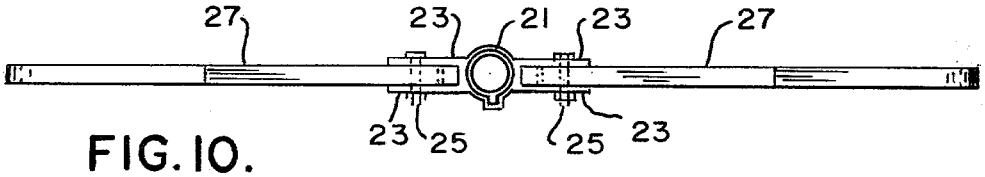
FIG. 10 is a horizontal sectional view taken along line 10—10 of FIG. 2, showing a top view of the foot supporting element in the stationary position in solid lines and in the unbraked axially movable position in broken lines.
Figure 11:
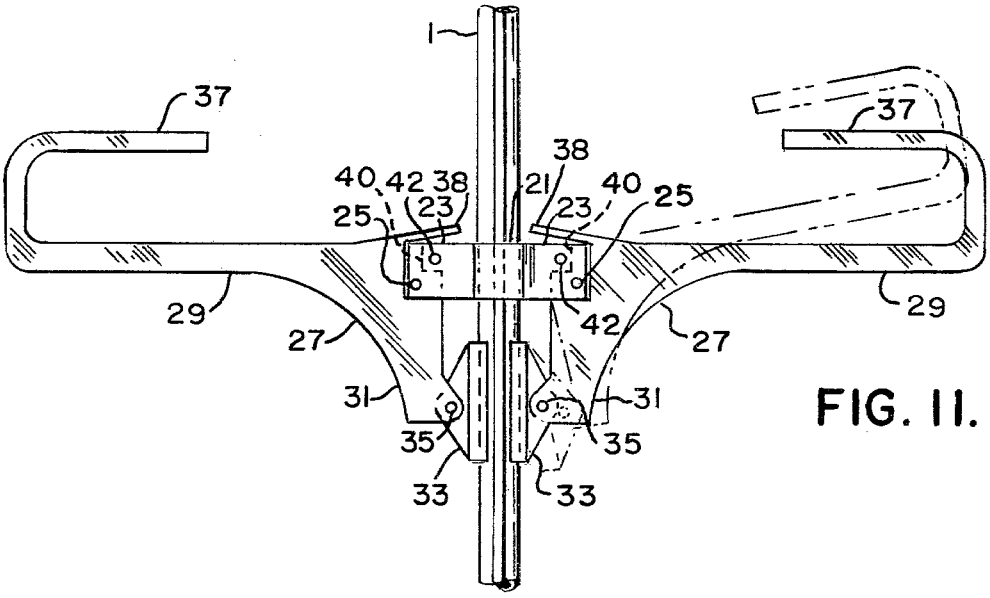
FIG. 11 is a front elevational view of the foot supporting element showing it in braked position in solid lines and with one side in the axial movable unbraked position in broken lines.

For supporting the feet of a user of the apparatus, a foot supporting element comprises a second collar 21, the internal surface of which corresponds to the external surface of pole 1, is non-rotatably and axially slidably mounted on pole 1 and is formed with a pair of bifurcated wings 23 to which are pivoted, by pins 25, bellcranks 27. Each bellcrank 27 has a transverse arm 29 and an arm 31 extending downwardly generally parallel to the axis of pole 1. For maintaining the foot supporting element at any desired position on pole 1, brake shoes 33 are pivoted at 35 to the lower end portions of axial arms 31 so that when the feet of the climber press downwardly on arms 29, brake shoes 33 will frictionally engage pole 1 and prevent movement of the foot supporting element axially of the pole. Each of the transverse arms 29 has a rebent outer end portion 37 adapted to overlie the shoe of a user of the apparatus to enable him to release the brake by lifting his feet, thereby causing the axial arms of the bellcranks to swing away from the pole and disengage brake shoes 33 from the pole to the position shown in broken lines in FIG. 10, and thereafter enabling him to raise the foot supporting element by pulling upwardly thereon with his feet. The inner ends of transverse arms 29 may be tapered slightly upwardly at 38 to make it possible for the user to release brake shoes 33 from engagement with the poles if he wishes to effect a rapid descent. For limiting the upward pivoting of the outer ends of the bellcranks 29–31 about pivot pins 25, the inner vertical surface of each of the axial legs 31 is cut away at 40 for engagement with a limit pin 42 mounted in the associated bifurcated wings 23.

For non-rotatably positioning the pole against the side of a building or the like, at its upper end a cross bar 39 is formed with a collar 41 slidably mounted on the pole for positioning axially thereof as desired and is secured in the desired position thereon by a suitable set screw 43. To space the pole a suitable distance from the wall, the end portions 45 of cross bar 43 are extended equal distances from the cross bar with their terminals 47 adapted to engage the building or wall structure.

Figure 4:
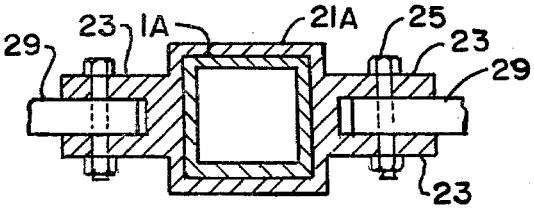
Figure 5:
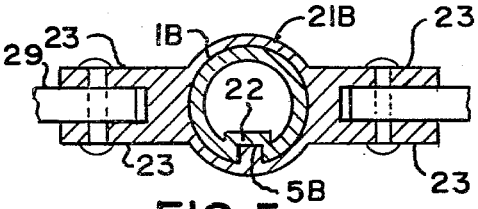

FIGS. 4 and 5 illustrate different pole and collar cross sections 1A and 21A and 1B and 21B, respectively, the pole 1A and collar of FIG. 4 being of polygonal, e.g., square, cross section and the pole 1B of FIG. 5 being of partially circular cross section with an axial groove 5B mating with a boss 22 on the internal surface of collar 1B. It will be seen that these and numerous other non-circular cross sections may be used to provide the desired axial mobility and at the same time make the collars non-rotatable on the poles.

Figure 1:
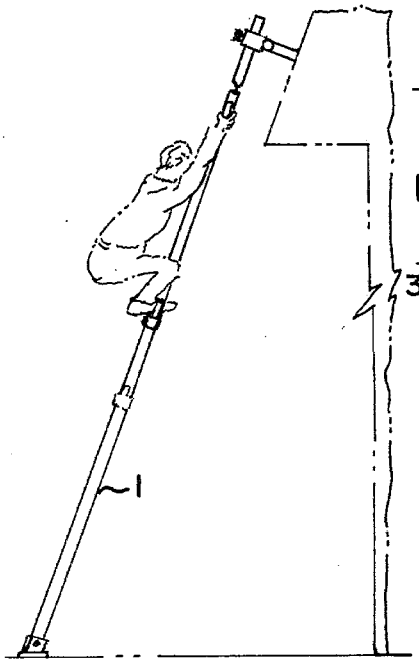
FIG. 1 is a side elevation of climbing apparatus constructed according to the invention in use position with its axis substantially inclined from the vertical.
Figure 2:
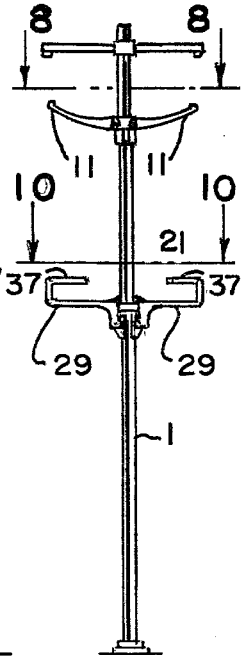
FIG. 2 is a front elevation of the climbing apparatus illustrated in FIG. 1.
Figure 6:
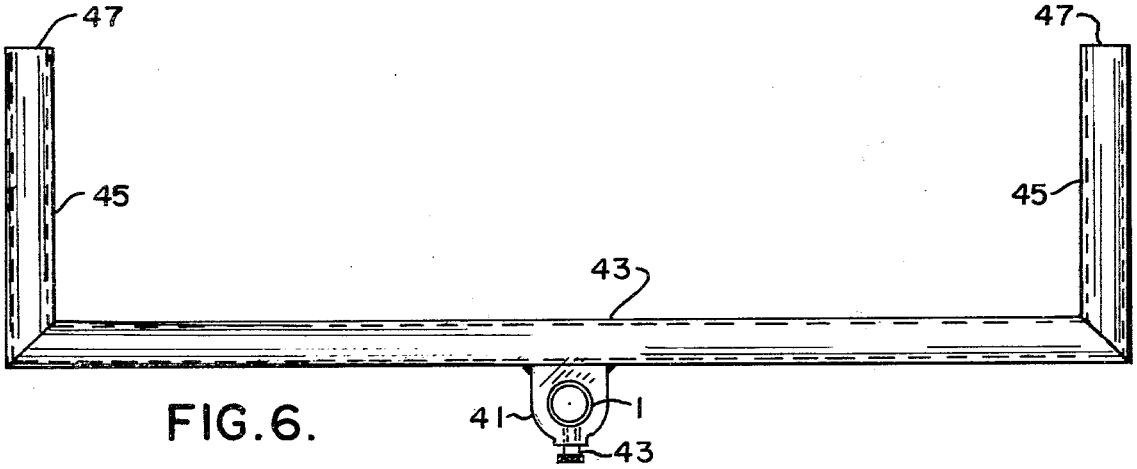
FIG. 6 is a top view of the apparatus showing means for non-rotatably supporting the pole from a building or other construction.
Figure 7:
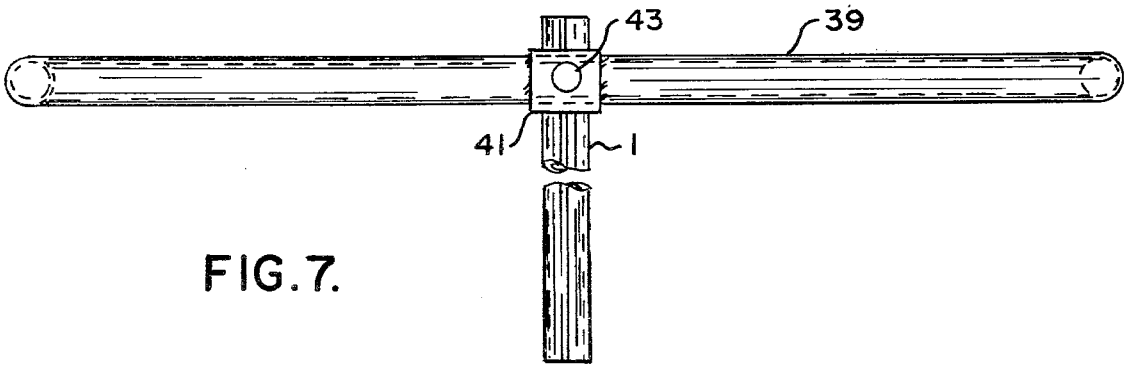
FIG. 7 is a front elevational view of the pole and non-rotatable support means, with the intermediate portion of the pole removed.
Figure 8:
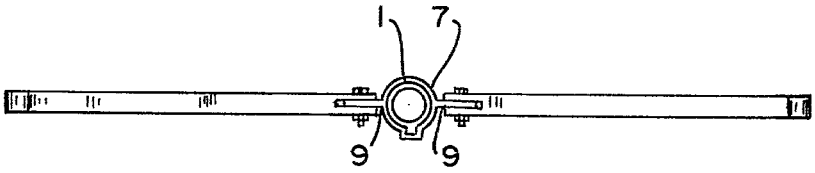
FIG. 8 is a horizontal sectional view taken along lines 8—8 of FIG. 2, showing a top view of the hand supporting element.
Figure 9:
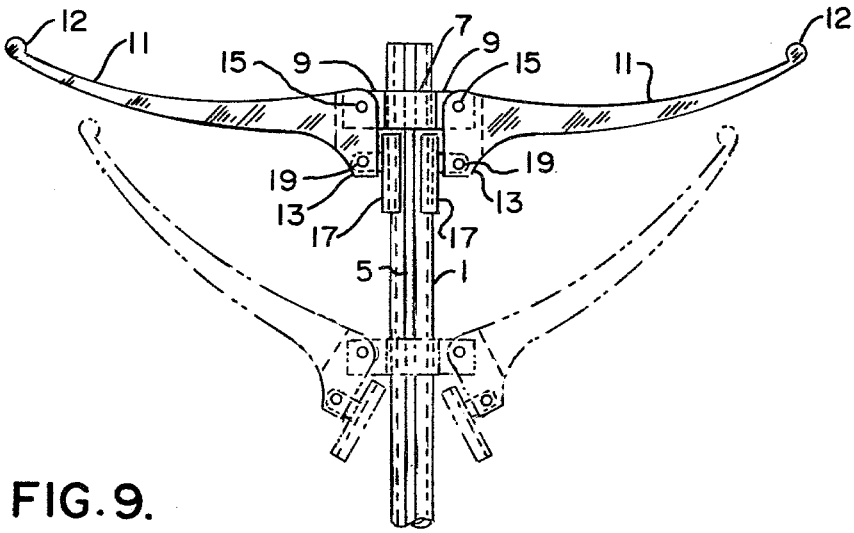
FIG. 9 is a front elevational view of the hand supporting element showing it in stationary braked position in solid lines and in axially movable unbraked position in broken lines.

Operation of the device is as follows: Preferably the pole is positioned as shown in FIG. 1, with the foot supporting element 21–37 at the bottom of the pole and the hand supporting element 7–19 positioned above it. The climber positions his feet on the end portions of foot supporting transverse arms 29 beneath the rebent end portions 37 thereof and grasps hand supporting arms 11, raising the latter to his full height with his arms extended, at which point he swings the hand supporting arms 11 to the braking position so as to lock the hand supporting element on the pole. Continuing to grasp the hand supporting arms 11, he hunches his body, thereby pulling up on the foot supporting element through the engagement of his shoes with rebent end portions 37 of foot supporting transverse arms 29 until he brings this up to a suitable height, at which time he presses downwardly on the end portions of foot supporting arms 29 without lowering the same so as to cause brake shoes 33 to engage the pole and thereby lock the foot supporting element against movement axially of the pole. If he wishes to ascend further with his feet in this position, he stretches his body, releasing the grip of the hand engaged element brake shoes 17 on the pole to free the hand engaged element and push the same upwardly along the pole to his full height. This procedure can be repeated until he reaches the top of the pole or any desired intermediate position on the pole. Descent of the pole can be accomplished gradually by a reversal of the ascending operation or rapidly by lifting up on the hand engaged arms 11 and simultaneously swinging the foot supporting arms upwardly about their fulcrums 25 by pressing on inner end 38 of arms 29 to release the brake shoes 17 and 33 from frictional engagement with the pole and a fast descent can be made.

In the second embodiment of the invention illustrated in FIGS. 12–16, the hand support structure 7–17 is eliminated and replaced by a seat element comprising a collar member having vertically spaced collars 53 and 55 slidably mounted on pole 1 and connected by tie members 57. Pole 1 is of some non-circular cross section and for exemplary purposes, is shown of the same section as that illustrated in FIG. 3 and collars 53 and 55 having a mating internal shape, although it will be understood that the pole may be of square section as shown in FIG. 4 or of the same cross section as shown in FIG. 5. A tension coil spring 59 is hooked at its upper and lower ends to washers 60 which have ears 62 pinned at 64 respectively to seat element bottom collar 55 to foot support element collar 21 for purposes which will hereinafter be described.

A seat 61 of bicycle type has clevis brackets 63 depending from its bottom and a nearly horizontal arm 65 of a bellcrank is pivoted at 67 to clevis brackets 63 on an axes transverse of the seat. The bellcrank is fulcrumed at 69 to a pair of clevis brackets 71 projecting forwardly from top seat support collar 53 and the other nearly vertical arm 73 of the bellcrank is bifurcated at its lower end at 75 to form a clevis in which is pivotally received at 77 a rib 79 on a brake shoe member 81 which is frictionally engageable with pole 1 for braking vertical sliding movements of the seat structure thereon. A tension coil spring 83 secured at one end to collar 53 and at its other end to the top of bellcrank arm 65 biases the bellcrank upwardly and away from pole 1 when the seat is unoccupied so as to maintain brake shoe 81 out of frictional braking engagement with pole 1. For manually raising the seat during operation of the apparatus, hook 85 (which may be used to support the bails of paint cans and the like) is formed with an elongated shank 87 projecting horizontally rearwardly from top collar 53.

The foot supporting element is the same as that of the first embodiment of FIGS. 1–11 except that on the bellcrank horizontal arms *29a*, the rebent end portions 37 are omitted.

An additional feature of the second embodiment is the provision, at the base of the pole, of a safety cushioning spring 89 seated against a bottom washer 90 engaging the base 92 of the pole and bearing upwardly against a top washer 94.

Operation of the modified form of the invention is as follows: The climber supports his feet on the foot support arms *29a* and grasps hook shank 87, raising the seat which is beneath him to the highest level which his body will permit with his legs extended. Still grasping hook shank 87, he sits on the seat causing bellcrank 65, 73 to pivot counterclockwise about it fulcrum 69 until brake shoe 81 is placed in tight braking engagement with pole 1 so that the seat cannot slide downwardly on the pole. He then bends his knees to a normal seated position to raise his feet away from engagement with foot support arms 29*a* and thereby release the foot support element brakes 33. This permits the tension of spring 59 to pull the foot supporting element 29*a* upwardly until arms 29*a* come into engagement with his feet, after which he presses down with his feet on foot support arms 29, placing them in braking relation with the pole, after which he stands on them and again grasps hook shank 87 to raise seat 61 as far as his body will permit it to be raised, sits on seat 61 causing brake shoes 81 to reengage pole 1, and lifts his feet up to a bent knee position, thereby permitting spring 59 to raise foot support arms 29 after which he presses downwardly with his feet on foot support arms 29 to brake them at the new level. This sequence may be repeated as many times as needed to move the climber to any desired height on the pole. Hook 85 can be used during the climb and when the climber reaches his desired height to support paint buckets, cans and the like for use from the seat.

The details of the construction may be varied substantially without departing from the spirit of the invention and the exclusive use of such modifications as come within the scope of the claims is contemplated.

I claim:

1. Climbing apparatus comprising a pole having means for maintaining it against rotation about its axis, a foot supporting element and another element for supporting another part of a climber's body, each of said supporting elements comprising a collar axially-slidably mounted on said pole, said pole and said collar having cooperating means preventing rotation of said collar about said pole, and a transverse arm pivoted to said collar for movement in an axial plane of said pole between positions substantially normal to the axis of said pole and upwardly inclined positions, each of said arms mounting an element frictionally engageable with said pole when said arms are in their lowermost positions for locking the respective element against undesired axial movement downwardly of said pole, said other element arm mounting a seat, said seat-mounting arm extending forwardly from said collar and being the first arm of a bellcrank having a second arm extending generally parallel to the axis of said pole, said frictionally engageable means being mounted on said second arm, means resiliently biasing said first arm and seat upwardly and said second arm outwardly from said pole, whereby when said seat is occupied by a climber said bellcrank pivots to move said frictionally engageable element into engagement with said pole to lock said element against downward movement.

2. Climbing apparatus according to claim 1, including hand engageable means on said seat element collar for manually raising said seat element when unoccupied by a body of a climber as when a climber is standing on said foot support element.

3. Climbing apparatus according to claim 2 including a resilient tension element connecting said seat element and said foot support element, whereby when said seat element has been lifted to and locked in excess of a predetermined distance above said foot supporting element, and said foot supporting element is unloaded, said foot supporting element will be automatically raised to said predetermined distance below said seat element.

4. Climbing apparatus according to claim 2, wherein said hand engageable means on said seat element collar has a hook-shaped portion for supporting articles usable by the climber.

5. Climbing apparatus according to claim 3, wherein said seat element collar is substantially elongated axially of the pole whereby to provide a stable support for said seat.

6. Climbing apparatus according to claim 3, wherein said seat element has a second collar spaced below said first collar and rigidly connected thereto to stabilize said seat with respect to said pole, said frictionally engageable element being positioned for engagement with said pole between said first and second said element collars.

* * * * *